US010865660B2

(12) United States Patent
Park

(10) Patent No.: US 10,865,660 B2
(45) Date of Patent: Dec. 15, 2020

(54) TRANSITION PIECE SUPPORT STRUCTURE, GAS TURBINE COMBUSTOR INCLUDING SAME, AND METHOD OF INSTALLING SAME

(71) Applicant: DOOSAN HEAVY INDUSTRIES & CONSTRUCTION CO., LTD., Changwon-si (KR)

(72) Inventor: Sung Wan Park, Busan (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 268 days.

(21) Appl. No.: 16/029,636

(22) Filed: Jul. 8, 2018

(65) Prior Publication Data

US 2019/0078470 A1 Mar. 14, 2019

(30) Foreign Application Priority Data

Sep. 12, 2017 (KR) ..... 10-2017-0116423

(51) Int. Cl.
*F23R 3/60* (2006.01)
*F01D 25/28* (2006.01)
(Continued)

(52) U.S. Cl.
CPC ..... *F01D 25/28* (2013.01); *F01D 9/023* (2013.01); *F23R 3/60* (2013.01); *F05D 2220/32* (2013.01);
(Continued)

(58) Field of Classification Search
CPC .. F01D 25/28; F01D 9/023; F23R 3/60; F23R 3/002; F23R 2900/00017; F05D 2260/30
See application file for complete search history.

(56) References Cited

U.S. PATENT DOCUMENTS 4,422,288 A * 12/1983 Steber ..... F01D 9/023 60/39.37
4,719,748 A * 1/1988 Davis, Jr. ..... F01D 5/187 60/39.37
(Continued)

FOREIGN PATENT DOCUMENTS

JP 2001-115860 A 4/2001
JP 4025172 B2 12/2007
(Continued)

OTHER PUBLICATIONS

A Japanese Office Action dated Jul. 16, 2018 in connection with Japanese Patent Application No. 2017-0116423 which corresponds to the above-referenced U.S. application.

*Primary Examiner* — Steven M Sutherland
(74) *Attorney, Agent, or Firm* — INVENSTONE Patent, LLC

(57) ABSTRACT

A transition piece support structure for a gas turbine combustor, and a method of installing same, reliably prevent leakage at the flange of a lower-side combustor, which is greatly influenced by gravity. The structure supports a rear end portion of a transition piece when fixed to a turbine end and includes a flange provided at a rear end of the transition piece, to be coupled to the end of the turbine, the flange having a shape to fit a periphery of a turbine inlet; a support bracket integrated with an upper surface of a flow sleeve surrounding an outer surface of the transition piece, to face the end of the turbine coupled to the flange; and a connection piece fixed to the end of the turbine and configured to be coupled to the support bracket in a hinged manner allowing the flange to pivotally approach the turbine inlet.

14 Claims, 9 Drawing Sheets

(51) Int. Cl.
*F01D 9/02* (2006.01)
*F23R 3/00* (2006.01)

(52) U.S. Cl.
CPC ..... *F05D 2230/60* (2013.01); *F05D 2240/35* (2013.01); *F05D 2260/30* (2013.01); *F23R 3/002* (2013.01); *F23R 2900/00017* (2013.01)

(56) References Cited

U.S. PATENT DOCUMENTS

| | | | | |
|---|---|---|---|---|
| 7,278,254 | B2 * | 10/2007 | Youngblood | F01D 9/023 60/39.37 |
| 7,555,906 | B2 * | 7/2009 | Anichini | F23M 5/04 60/799 |
| 8,418,474 | B2 * | 4/2013 | Rizkalla | F01D 9/023 60/752 |
| 2009/0145137 | A1 * | 6/2009 | Rizkalla | F01D 25/28 60/796 |
| 2009/0249791 | A1 * | 10/2009 | Belsom | F23R 3/60 60/755 |
| 2011/0140370 | A1 * | 6/2011 | Sutcu | F01D 11/005 277/603 |

FOREIGN PATENT DOCUMENTS

| | | | |
|---|---|---|---|
| JP | 2013-185814 | A | 9/2013 |
| KR | 10-0448060 | A | 9/2004 |
| KR | 20-0368672 | Y1 | 11/2004 |
| KR | 10-0977007 | B1 | 8/2010 |

* cited by examiner

TRANSITION PIECE SUPPORT STRUCTURE, GAS TURBINE COMBUSTOR INCLUDING SAME, AND METHOD OF INSTALLING SAME

CROSS REFERENCE TO RELATED APPLICATIONS

The present application claims priority to Korean Patent Application No. 10-2017-0116423, filed Sep. 12, 2017, the entire contents of which is incorporated herein for all purposes by this reference.

BACKGROUND OF THE DISCLOSURE

1. Field of the Disclosure

The present disclosure relates to gas turbines and, more particularly, to a transition piece support structure for a gas turbine combustor, a gas turbine combustor including the same, and a method of installing the same.

2. Description of the Background Art

A combustor is a component of a gas turbine and is provided between a compressor and a turbine of the gas turbine. The combustor mixes compressed air supplied from the compressor with fuel and burns the air-fuel mixture at constant pressure to produce high-energy combustion gas which is sent to the turbine that converts the thermal energy of the combustion gas into mechanical energy.

To perform these functions, the combustor is constructed such that compressed air supplied by the compressor and fuel are mixed in a casing of the combustor and the air-fuel mixture is ignited and burned in a combustion chamber provided inside a liner. Thus, high-temperature high-pressure combustion gas is produced in the combustion chamber, which is then sent to the turbine through a transition piece connected to the liner. For this reason, a rear end L of the transition piece needs to be securely and stably fixed to a turbine inlet 1310 so that the combustion gas can be reliably supplied to the turbine (refer to FIG. 2).

However, a conventional transition piece support structure has a problem in that a continuous gas leakage, although very small, is likely to occur at a lower end because a flange 10 located at a lower end (i.e., rear end) of a transition piece may be insecurely fixed or because the flange 10 may be continuously subjected to a resisting force against rotational deformation acting on the entire transition piece.

Particularly, in the case of a lower combustor 1200*b* (refer FIG. 3) provided on the opposite side of an upper combustor 1200*a*, the lower combustor 1200*b* is subject to rotational moment acting in a direction (indicated by an arrow) which is opposite to a direction in which the lower combustor 1200*b* is initially rotated for installation, due to gravity. Therefore, over time, a lower flange, which means a flange provided at an upper portion of the lower combustor 1200*b*, suffers an increasing spacing L-2 from the gas turbine, which may result in a gas leakage at the flange. For this reason, the overall thermal expansion of the combustor increases, which negatively affects the function or structure of the gas turbine.

SUMMARY OF THE INVENTION

In order to accomplish the above objects, there is provided a transition piece support structure for supporting a rear end portion of a transition piece fixed to an end of the turbine. The structure may include a flange provided at a rear end of the transition piece and configured to be coupled to the end of the turbine, the flange having a shape to fit a periphery of an inlet of the turbine; a support bracket integrated with an upper surface of a flow sleeve surrounding an outer surface of the transition piece and configured to face the end of the turbine coupled to the flange; and a connection piece coupled to the end of the turbine and configured to be coupled to the support bracket in a hinged manner allowing the flange to pivotally approach the inlet of the turbine.

The structure may further include a rotation control member provided at a contact between the support bracket and the connection piece. The rotation control member may be provided to each of a first rotary plate protruding from a surface of the support bracket and a second rotary plate formed on a surface of the connection piece, wherein the rotation control member of the first rotary plate and rotation control member of the second rotary plate are configured to engage with each other. The rotation control members may include teeth-shaped protrusions configured to allow a first direction rotation but to prohibit a second direction rotation which is reverse with respect to the first direction rotation.

The rotation control member may include a key for preventing rotation of the support bracket; and a first key-receiving recess formed in a surface of the first rotary plate and a second key-receiving recess formed in a surface of the second rotary plate, the first and second key-receiving recesses having an equal width, wherein, by a relative rotation of the first and second rotary plates, the first key-receiving recess and the second key-receiving recess can be aligned with each other to form a key hole for receiving the key.

The flange may include a bolting plate extending downward from a lower end of the flange, for coupling the flange to the end of the turbine. The bolting plate may be provided with at least two coupling holes spaced apart from each other in a width direction of the flange.

The structure may further include a pin unit provided to couple the connection piece and the support bracket and configured to enable a relative rotation between the connection piece and the support bracket.

The support bracket may be configured as at least two brackets protruding from the upper surface of the flow sleeve, and the pin unit is configured with at least two pins to couple the at least two brackets respectively to the connection piece in the hinged manner.

The pin unit may include a bolt passing through the support bracket and the connection piece to engage with a nut; a first washer disposed between a bolt head of the bolt and the support bracket; and a second washer disposed is provided between the connection piece and the nut.

The support bracket may protrude from the upper surface of the flow sleeve so as to be disposed in front of the flange.

According to another aspect of the present invention, there is provided a gas turbine combustor provided with the above transition piece support structure. The gas turbine combustor may include a transition piece; a liner connected to the transition piece via an elastic support member; and a flow sleeve configured to surround outer surfaces of the transition piece and the liner.

According to another aspect of the present invention, there is provided a method of installing a transition piece support structure to fix a transition piece for a gas turbine combustor to a turbine end. The method may include bringing a support bracket integrated with an upper surface of a flow sleeve surrounding an outer surface of the transition piece close to a connection piece fixed with respect to the turbine end; coupling the connection piece and the support bracket in a hinged manner; rotating the transition piece together with the support bracket with respect to the connection piece so that a flange provided at a rear end of the transition piece pivotally approaches a turbine inlet; fitting the flange to a periphery of the turbine inlet; and fixing the flange to the turbine end.

The flange may be fixed to the turbine end by inserting a bolt through a coupling hole formed in a bolting plate extending downward from a lower end of the flange.

The connection piece may be coupled to the support bracket by inserting a pin unit, the inserted pin unit enabling the rotation of the transition piece together with the support bracket with respect to the connection piece.

As described above, when the present disclosure is applied to a combustor of a gas turbine, the entire area of the flange provided at the rear end of the transition piece can be securely and stably fixed to the turbine end. Therefore, it is possible to prevent the rotary deformation which often occurred in the conventional art due to a hinged coupling structure of the support bracket, thereby preventing a gas leakage at the flange.

Particularly, for a combustor installed at a lower side of a gas turbine and subjected to a stronger rotary force acting in the reverse direction due to a higher self-load, it is possible to prevent the leakage attributable to the stronger rotary force.

The effects, features, and objects of the present disclosure are not limited to the ones mentioned above, and other effects, features, and objects not mentioned above can be clearly understood by those skilled in the art from the following description.

BRIEF DESCRIPTION OF THE DRAWINGS

The above and other objects, features and other advantages of the present disclosure will be more clearly understood from the following detailed description when taken in conjunction with the accompanying drawings, in which.

BRIEF DESCRIPTION OF THE DRAWINGS

Hereinafter, preferred embodiments of the present disclosure will be described in detail with reference to the accompanying drawings. Prior to giving the following detailed description of the present disclosure, it should be noted that the terms and words used in the specification and the claims should not be construed as being limited to ordinary meanings or dictionary definitions but should be construed in a sense and concept consistent with the technical idea of the present disclosure.

It will be further understood that when an element is referred to as being "on" another element, it can be directly on the other element or intervening elements may be present therebetween. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, integers, steps, operations, elements, and/or components.

An idealized thermodynamic cycle of a gas turbine is the Brayton cycle. The Brayton cycle consists of a sequence of four processes, namely, isentropic compression (adiabatic compression), constant pressure heat addition, isentropic expansion (adiabatic expansion), and constant pressure heat removal. In other words, after air in the atmosphere is taken in, the intake air is compressed to have a high pressure, a mixture of the compressed air and fuel is burned at constant pressure to release heat energy, high temperature combustion gas is expanded to turn into kinetic energy, and finally the exhaust gas containing residual thermal energy is discharged into the atmosphere. That is, the cycle consists of compression, heating, expansion, and heat radiation.

Figure 1:
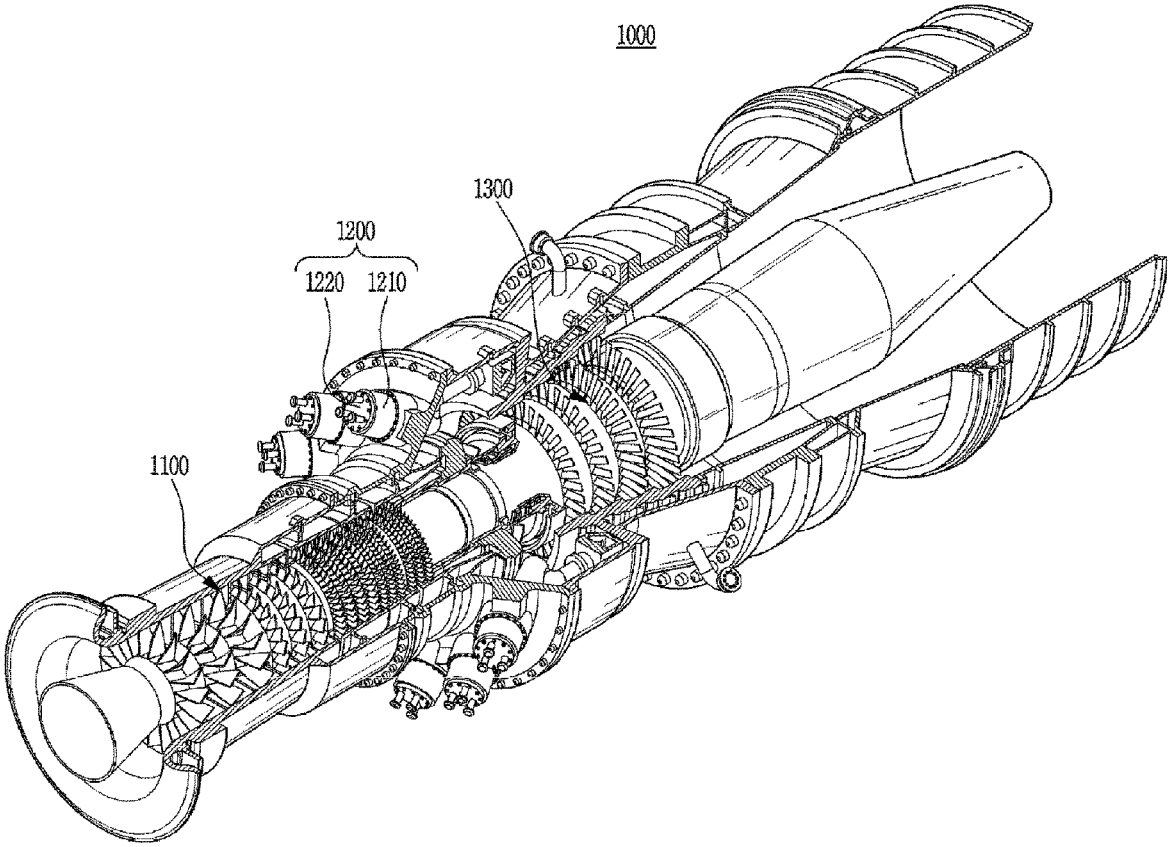
FIG. 1 is a cutaway perspective view illustrating the overall construction of a gas turbine.

As shown in FIG. 1, a gas turbine 100 that implements such a Brayton cycle includes a compressor 1100, a combustor 1200, and a turbine 1300. Although the description of the present disclosure is made with reference to FIG. 1, the description may be applied to diverse turbines having an equivalent structure.

The compressor 1100 takes in air, compresses the intake air, and supplies the compressed air to a combustor 1200. The compressor 1100 also supplies cooling air to high-temperature regions of the gas turbine 1000 to cool the high-temperature regions. The intake air is adiabatically compressed in the compressor 1100, increasing the pressure and temperature of air passing through the compressor 1100.

The compressor 1100 is generally configured with either a centrifugal or axial compressor. Typically, a small gas turbine is equipped with a centrifugal compressor. On the other hand, the large gas turbine 1000 of FIG. 1 is typically equipped with a multi-stage axial compressor 1100 to compress a large amount of air.

The compressor 1100 is driven by a portion of the output power produced by the turbine 1300. To this end, as illustrated in FIG. 1, a rotational shaft of the compressor 1100 and a rotational shaft of the turbine 1300 are directly connected. In the case of the large gas turbine 1000, approximately half of the output power produced by the turbine 1300 is consumed to drive the compressor 1100. Thus, improvement of the efficiency of the compressor 1100 has a direct and significant effect on improvement of the overall efficiency of the gas turbine 1000.

Figure 2:
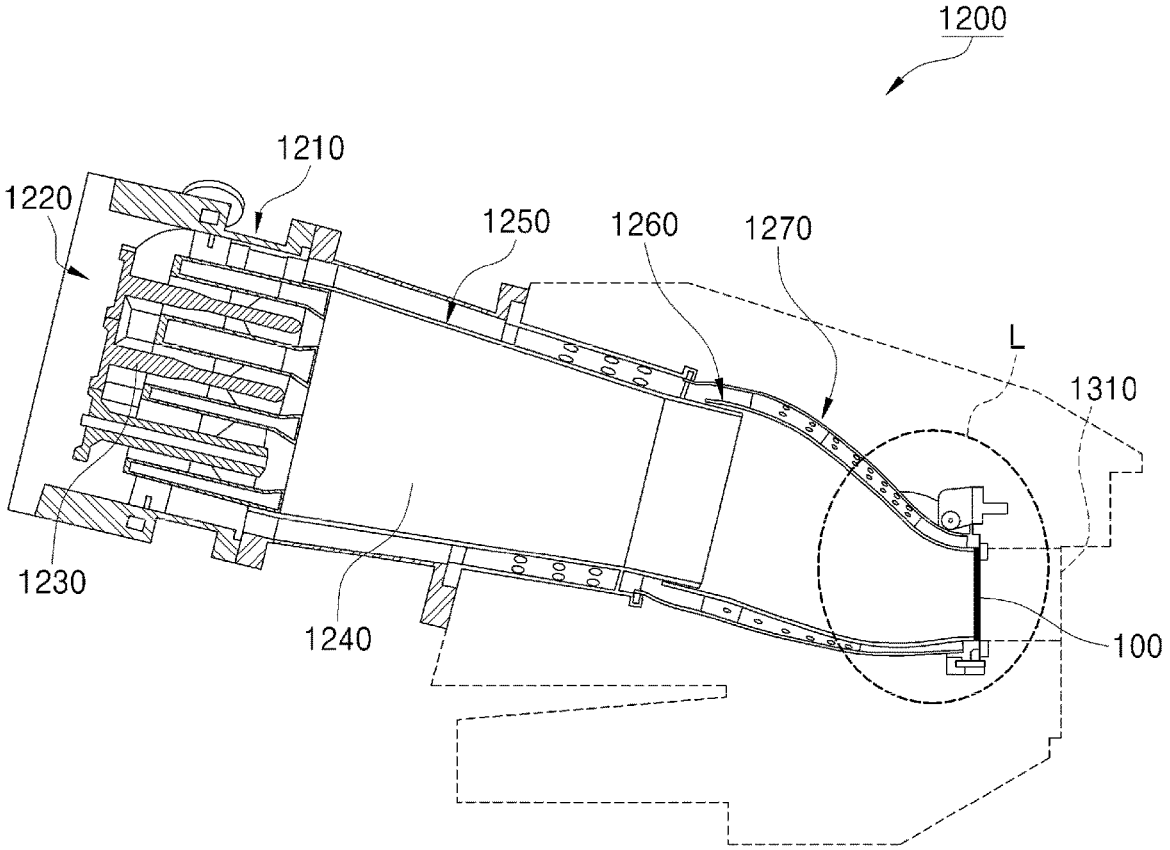
FIG. 2 is a schematic diagram of a gas turbine combustor and a rear end thereof.
Figure 3:
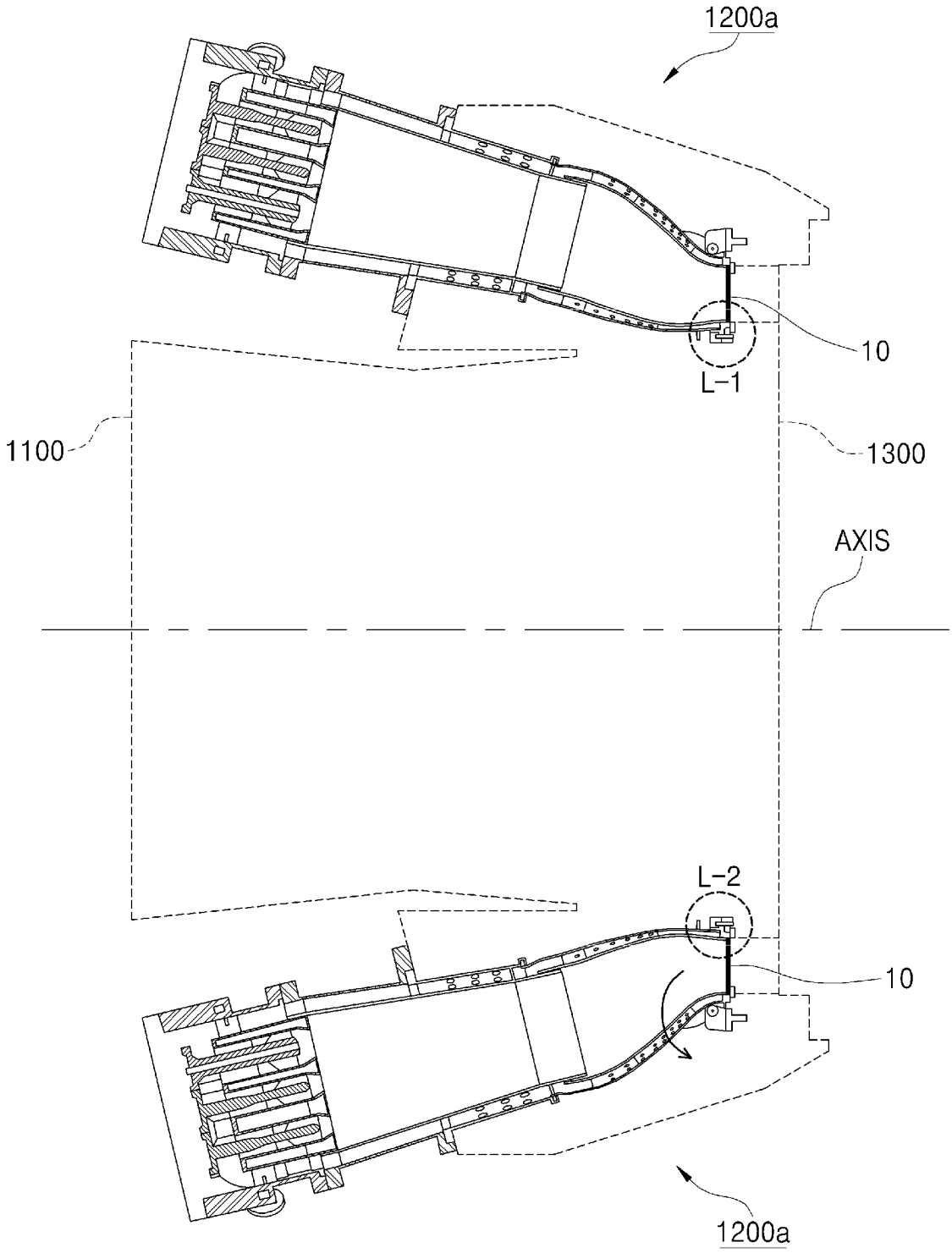
FIG. 3 is a schematic diagram illustrating the overall construction of an upper combustor and a lower combustor of a typical gas turbine.

The combustor 1200 mixes the compressed air supplied from the outlet of the compressor 1100 with the fuel and burns the fuel-air mixture under constant pressure to produce high-energy combustion gas. FIG. 2 illustrates an example of the combustor 1200 of the gas turbine 1000. The combustor 1200 is disposed downstream of the compressor 1100, and multiple burners 1220 are arranged along an annular casing 1210 of the combustor. Each burner 1220 is provided with several combustion nozzles 1230. The fuel injected from the combustion nozzles 1230 is mixed with the compressed air in an appropriate ratio to become a suitable state for combustion.

The gas turbine 1000 may use a gaseous fuel, a liquid fuel, or a composite fuel obtained by mixing the two. It is important to create a combustion environment capable of reducing the amount of emission gases that may be subject to legal regulation, such as carbon monoxide and nitrogen oxides. Therefore, although proper control is relatively difficult to achieve, premixed combustion has recently been employed widely, because premixed combustion lowers the combustion temperature and enables uniform combustion, which results in a reduction in the emission gases subject to regulation. In premixed combustion, compressed air is first mixed with fuel injected through the combustion nozzles 1230 and then enters the combustion chamber 1240 as a premixed gas. The premixed gas is initially ignited by an igniter. Thereafter, when the combustion environment is stabilized, fuel and air are supplied to the combustion chamber to maintain the combustion.

The combustor 1200 is the hottest region of the gas turbine 1000, and proper cooling is required. Referring to FIG. 2, a duct assembly is composed of a liner 1250, a transition piece 1260, and a flow sleeve 1270. The duct assembly connects the burner 1220 and the turbine 1300 and serves as a flow path for a hot combustion gas. The compressed air flows along the outer surface of the duct assembly to be supplied to the combustion nozzles 1230. In this process, the duct assembly heated by the hot combustion gas is appropriately cooled by the compressed air flowing along the surface of the duct assembly.

The duct assembly has a dual structure in which the flow sleeve 1270 surrounds outer surfaces of both the liner 1250 and the transition piece 1260, which are connected to each other via an elastic support 1280. The compressed air is introduced into an annular space provided inside the flow sleeve 1270, thereby cooling the liner 1250 and the transition piece 1260.

One end of the liner 1250 is fixed to the combustor 1200, and the opposite end of the transition piece 1260 is fixed to the turbine 1300. Therefore, the elastic support 1280 has to have a structure that can accommodate a thermal expansion of the liner 1250 and the transition piece 1260 and their resulting elongation in both the axial and radial directions.

The high-temperature high-pressure combustion gas produced in the combustor 1200 is supplied to the turbine 1300 through the duct assembly. In the turbine 1300, the combustion gas adiabatically expands to impact multiple blades radially arranged on the rotational shaft of the turbine 1300 while causing a reaction force. In this way, thermal energy of the combustion gas is converted into mechanical energy that rotates the rotational shaft. A portion of the mechanical energy obtained from the turbine 1300 is supplied to the compressor as energy required to compress the air, and the remainder is utilized as the effective energy, for example, energy for generating electric power by driving an electric generator.

As described above, since the main components of the gas turbine 1000 do not perform a reciprocating motion, the gas turbine 1000 has no mutually frictional components such as a piston and cylinder and therefore exhibits several advantages. These advantages include consuming an extremely small amount of lubricating oil, greatly reducing the amplitude that is the nature of a reciprocating machine, and performing high-speed movement.

In addition, in the Brayton cycle, the thermal efficiency increases as the compression ratio of the air increases and as the temperature (turbine inlet temperature) of the combustion gas flowing into an isentropic expansion process increases. Therefore, recent development of the gas turbine 1000 has been in the direction of increasing the air compression ratio and the inlet temperature of the turbine.

A transition piece support structure and a method of installing the structure, which are applicable to the combustor 1200 and the transition piece 1260 of the gas turbine 1000, will be described in detail with reference to FIGS. 4 to 9.

Figure 4:
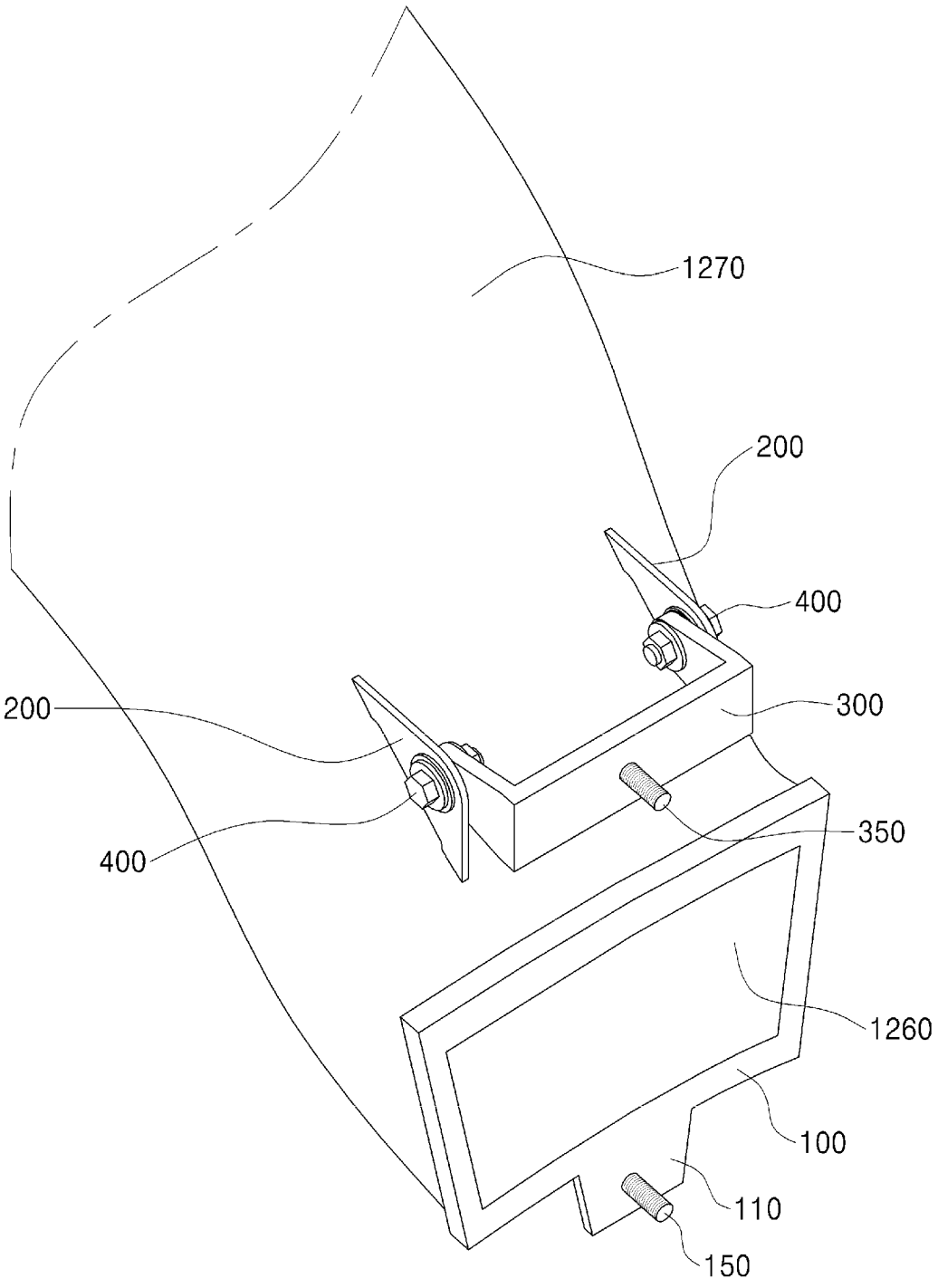
FIG. 4 is a perspective view of a transition piece support structure according to one embodiment of the present disclosure.
Figure 5:
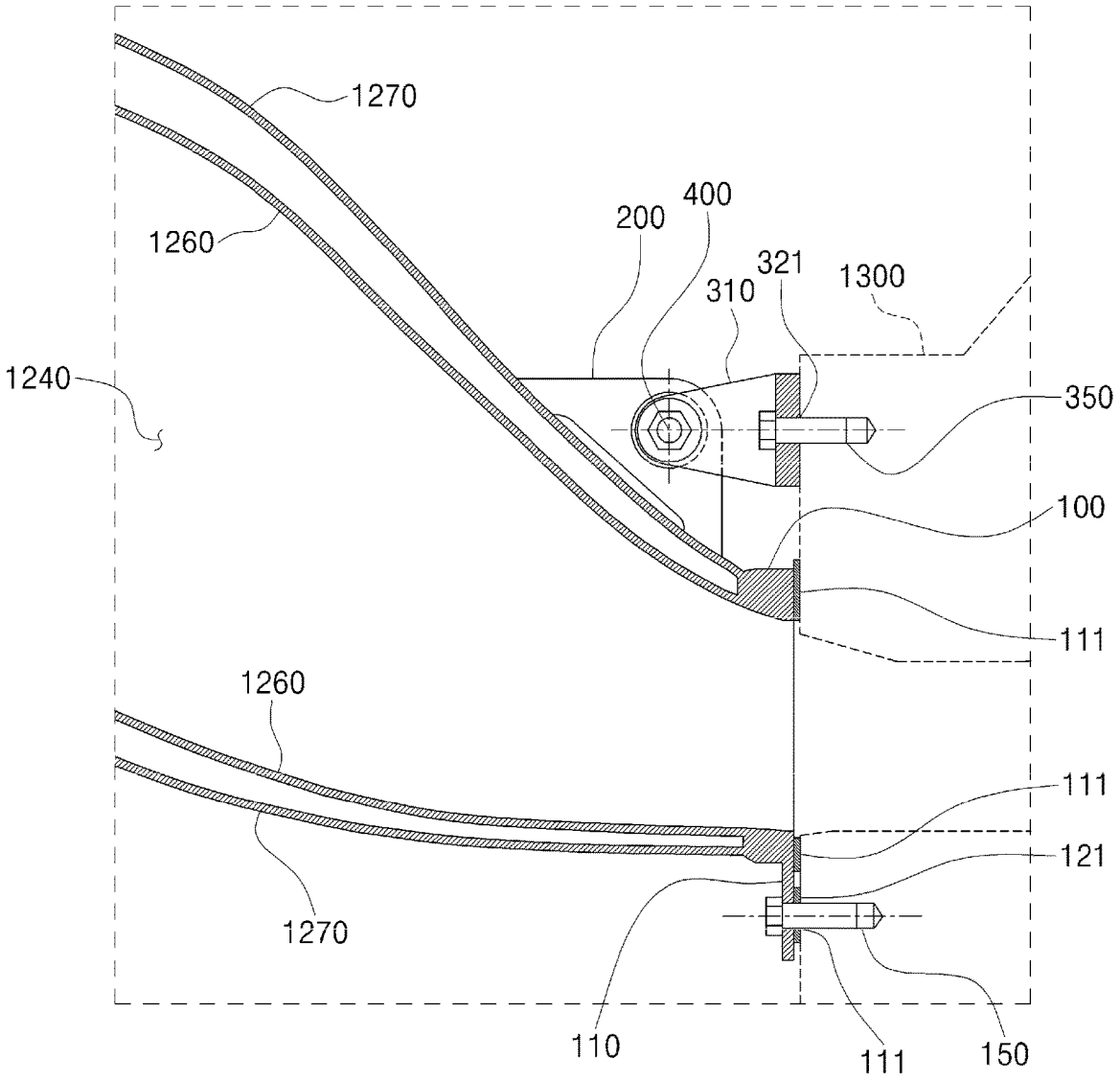
FIG. 5 is a cross-sectional view of the transition piece support structure of FIG. 4.
Figure 6:
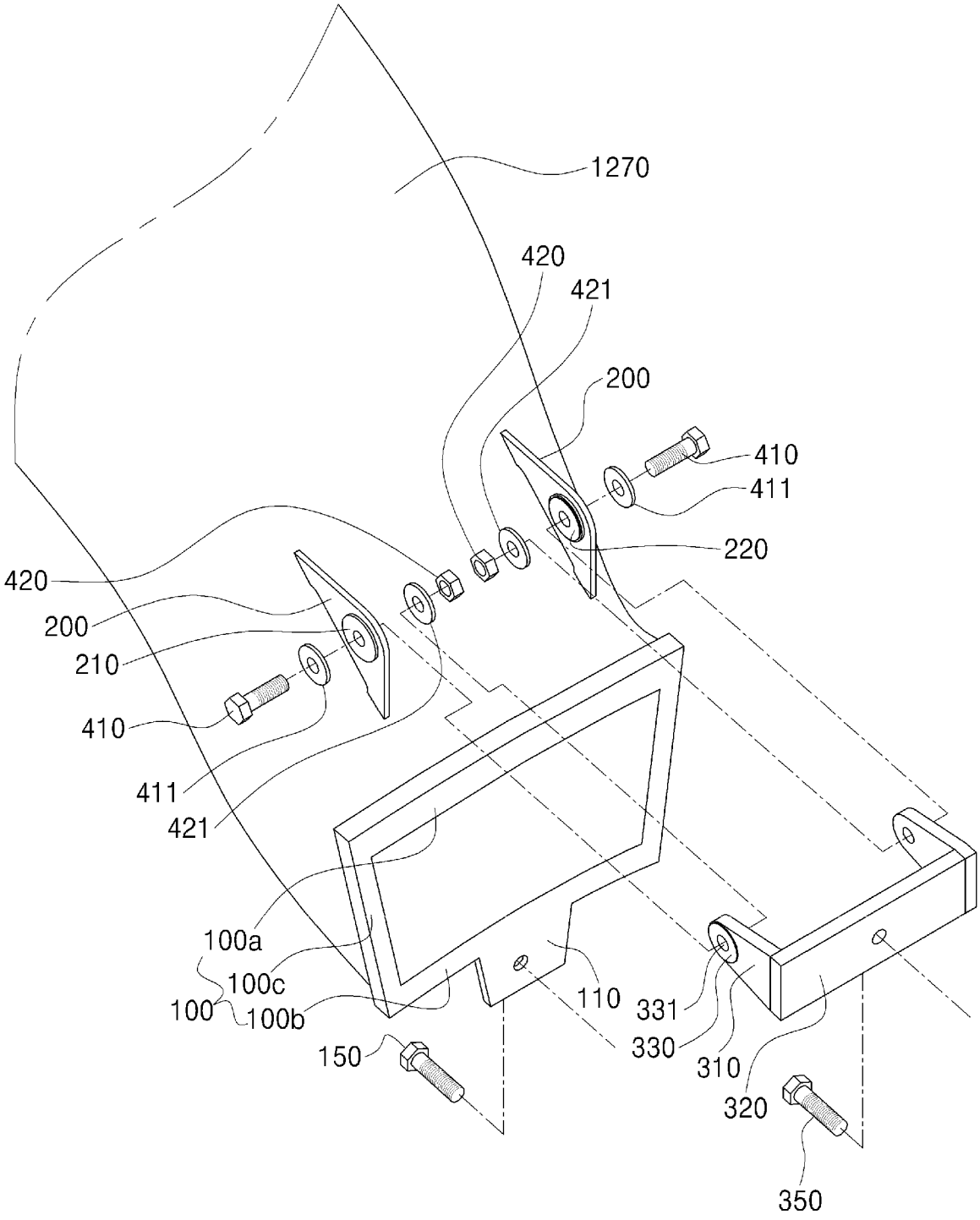
FIG. 6 is an exploded perspective view of the transition piece support structure of FIG. 4.

FIGS. 4 to 6 illustrate a transition piece support structure according to one embodiment of the present disclosure.

As described above, the combustor 1200 includes a duct assembly including the transition piece 1260, the liner 1250 connected to the transition piece 1260 via the elastic support 1280, and the flow sleeve 1270 provided to surround the outside surfaces of the transition piece 1260 and the liner 1250. The present invention relates to a structure for supporting a rear end of the transition piece, which corresponds to a rear end of the duct assembly to be fixed to a stage of the turbine.

The rear end portion of the transition piece 1260 refers to the rear end portion of the duct assembly. That is, the rear end portion includes not only the rear end of the transition piece 1260 but also the rear end of the flow sleeve 1270 surrounding the outer surface of the transition piece 1260. The rear end portion also means a portion of the duct assembly, ranging from a flange 100 provided at the rear end of the transition piece to a supporting portion at which a support bracket 200 to be engaged with a connection piece 300 of a turbine is formed.

Accordingly, referring to FIG. 4, the transition piece support structure of the present disclosure includes the flange 100, the support bracket 200, the connection piece 300, and a pin unit 400.

The flange 100 is positioned at the rear end of the transition piece 1260 and is configured to abut against a turbine inlet 1310 (FIG. 5). Specifically, the flange 100 includes an upper flange portion 100*a*, a lower flange portion 100*b*, and left and right flange portions 100*c* and 100*d* connected to the upper and lower flange portions 100*a* and 100*b* (FIG. 6). That is, the shape of the flange 100 corresponds to the periphery of the turbine inlet 1310. In addition, when the flange 100 is coupled to the turbine inlet 1310, the flange 100 is provided with sealing members 1111 at the upper, lower, left, and right flange portions so that the high-pressure high-temperature combustion gas can smoothly continuously flow.

Nevertheless, the flange 100 is subjected to vibration and impact attributable to the operation of the gas turbine and the rotational resistance that acts around the pin unit 400. Particularly, the lower flange portion 100*b* suffers a continuous leakage due to an incomplete fixture thereof. In order to prevent this problem, the flange 100 of the present invention is provided with a bolting plate 110 extending downward from the lower end of the flange, and the bolting plate 110 is provided with a coupling hole 111 through which a bolt 150 passes to couple the flange 100 to the turbine end.

As described above, with the use of the bolting plate 110, it is possible to prevent the leakage which occurs due to the incomplete fixation of the flange 100 to the turbine end, thereby reducing the amount of thermal expansion in the entire combustor.

The bolting plate 110 is provided preferably with at least two coupling holes 111 spaced apart widthwise. With more than one coupling hole 111 provided in the bolting plate 110, it is possible to more effectively prevent the gas leakage at the rear end to the transition piece in the case where the lower flange portion 100*b* is longer than the left and right flange portions 100*c* and 100*d* to fit the inlet end of the turbine.

The support bracket 200 is provided in front of the flange 100 and protrudes from the upper surface of the flow sleeve 1270 configured to surround the outer surface of the transition piece 1260. The support bracket 200 may be welded to the upper surface of the flow sleeve 1270 so as to be integrated with the flow sleeve 1270.

More specifically, as the support bracket 200, at least two support brackets 200 are formed to protrude from the upper surface of the flow sleeve 1270. In addition, as the pin unit 400, at least two pin units 400 are respectively provided so that the two support brackets 200 are hinged to the connection piece 300. It is preferable that the number and the spacing of the supporting brackets 200 are determined according to the width of the rear end of the transition piece.

The connection piece 300 is coupled to the inlet end of the turbine which is arranged to face the support bracket 200. Referring to FIG. 5, the connection piece 300 is composed of first contact pieces 310 to be brought into contact with the respective support brackets 200, and a second contact piece 320 provided with a coupling hole 321 through which a coupling unit 350 is inserted to couple the second contact piece 320 to the turbine end. The first contact pieces 310 and the second contact piece are preferably provided as an integrated single body. The connection piece 300 may be integrated with the turbine end by welding or the like, as an alternative to the case where the connection piece 300 and the turbine end are separately provided and coupled to each other by using the coupling unit 350.

The pin units 400 are configured to couple the connection piece 300 and the support brackets 200 in a hinged manner. Therefore, when the combustor including the transition piece is installed or assembled, the flange 100 provided at the rear end of the transition piece may be brought closer to the turbine inlet 1310 in a pivoted manner, which facilitates installation and maintenance work.

To enable a pivoting or turning movement of the transition piece while bearing the weight of the transition piece, referring to FIG. 6, the pin unit 400 is configured such that a bolt 410 is inserted to pass through the support bracket 200 and the connection piece 300 to finally engage with a nut 420. Particularly, a first washer 411 is provided between a bolt head of the bolt 410 and the support bracket 200 and a second washer 421 is provided between the connection piece 300 and the nut 420.

Figure 7:
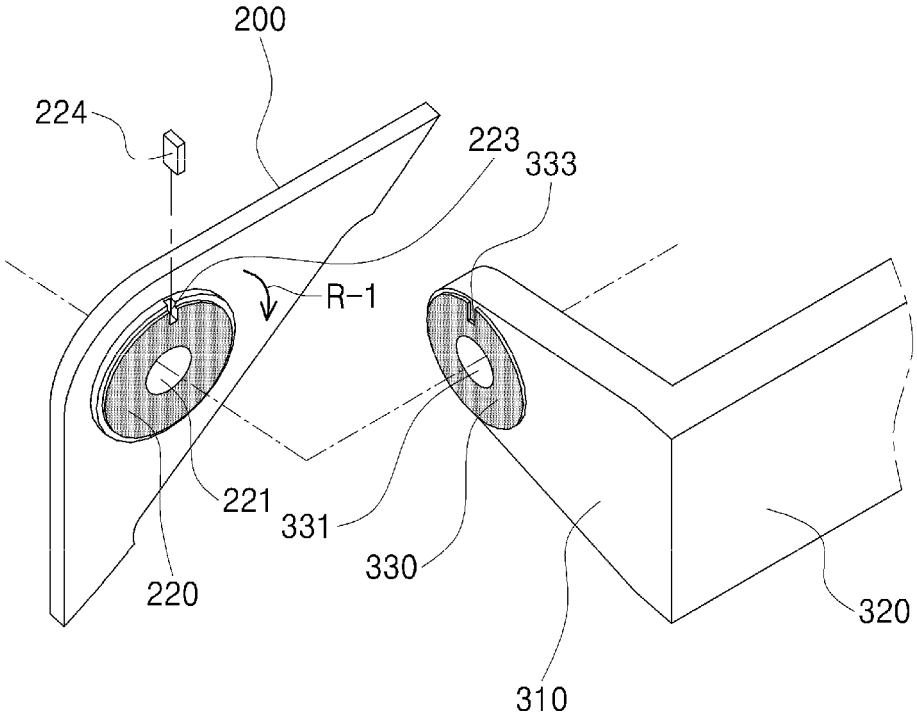
FIG. 7 is an exploded perspective view of a rotational control member of the transition piece support structure according to one embodiment of the present disclosure.
Figure 8:
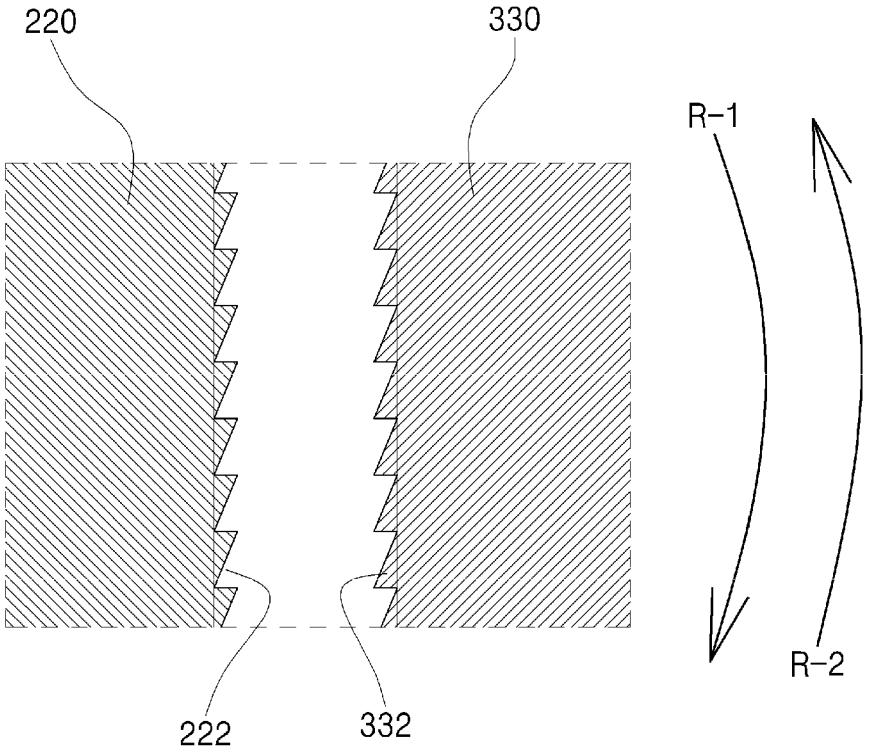
FIG. 8 is a cross-sectional view illustrating the shape of teeth-like protrusions formed on a first rotary plate and a second rotary plate of the rotation control member of FIG. 7.

FIG. 7 illustrates a rotation control member of the transition piece support structure according to one embodiment of the present disclosure, and FIG. 8 illustrates a configuration in which the rotation control members of FIG. 7 are teeth-like protrusions formed on the surfaces of the first rotary plate and the second rotary plate.

Referring to FIGS. 7 and 8, the rotation control member is a structure to resist rotary deformation that is likely to occur at a lower end of the transition piece. The rotation control member may be provided to the support bracket 200 and the connection piece 300, especially at positions where the support bracket 200 and the connection piece 300 come into contact with each other.

As the rotation control member, a surface of the support bracket 200 is provided with a first rotary plate 220 that protrudes from the surface, and a surface of the connection piece 300 is provided with a second rotary plate 330 that protrudes from the surface. The first rotary plate 220 and the second rotary plate 330 are formed to come into contact with each other and are provided with respective rotation control members.

Referring to FIG. 8, the rotation control members allow a first direction rotation (R-1 rotation) and prohibit a second direction rotation (R-2 rotation) which is the reverse of the first direction rotation, thereby allowing only unidirectional rotation. The opposing surfaces of the first rotary plate 220 and the second rotary plates 330 are provided with teeth-like protrusions 222 and 332, respectively. Therefore, when the combustor including the transition piece is initially assembled, or reassembled after maintenance work, since the second direction rotation (R-2 rotation) is prevented, it is possible to ensure ease of installation and safety against the rotation moment in the reverse direction which occurs due to gravity acting on the lower combustor 1200*b*, and to minimize the likelihood of occurrence of gas leakage after installation of the combustor.

Referring to FIG. 7, the rotation control member may further include key-receiving recesses 223 and 333 and a key 224 to be inserted into a key hole formed when the key-receiving recesses 223 and 333 are combined, thereby preventing the rotation of the support bracket 200.

Particularly, the key-receiving recesses 223 and 333 are formed to have an equal width and are respectively provided in the first rotary plate and the second rotary plate. The key 224 can be inserted into the key hole formed, which is formed when the support bracket 200 provided with the first rotary plate 220 is rotated to align the key-receiving recess 223 of the first rotary plate with the key-receiving recess 333 of the second rotary plate 330.

Figure 9:
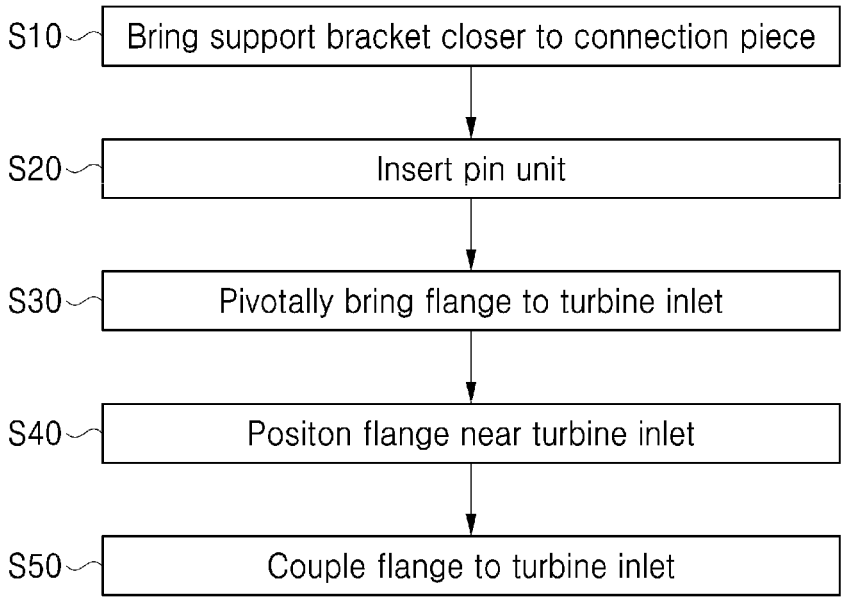
FIG. 9 is a flowchart illustrating a method of installing the transition piece support structure to a turbine, according to one embodiment of the present disclosure.

FIG. 9 illustrates a method of installing the transition piece support structure to a turbine, according to one embodiment of the present disclosure.

Referring to FIG. 9, the method of installing the transition piece support structure of the present disclosure is a method of fixing a transition piece to a stage of a turbine. According to the method, support brackets 200 that are formed to protrude from an upper surface of a flow sleeve 1270 configured to surround the outer surface of a transition piece 1260 is brought close to a connection piece 300 coupled to a stage of a turbine at Step S10.

Next, pin units 400 are inserted to couple the connection piece 300 to the support brackets 200 in a hinged manner at Step S20.

Next, the transition piece integrated with the support brackets 200 is pivoted about the pin units 400 so that a flange 100 provided at a rear end of the transition piece is brought close to the turbine inlet 1310 at Step S30.

The opposing surfaces of the support brackets 200 and the connection piece 300 may be provided with first rotation control members to allow only a unidirectional rotation. That is, the rotation in a first direction in which transition piece is rotated for installation is allowed but the reverse rotation (rotation in a second direction) is prevented. The first rotation control member may be teeth-like protrusions formed on the surfaces of the first rotary plate 220 and the second rotary plate 330.

Next, the flange 100 is positioned to be near by the periphery of the turbine inlet 1310 at Step S40. (Or the flange 100 can be positioned to be aligned with the periphery of the turbine inlet) A bolt 150 is inserted to pass through a coupling hole formed in a bolting plate 110 extending down from a lower end of the flange 100, thereby coupling the flange 100 to the turbine at Step S50.

The support bracket 200 and the connection pieced 300 may be provided with second rotation control members at contact portions thereof to prevent the rotation of the support brackets 200. Particularly, the first rotary plate 220 is provided with the first key-receiving recess 223 and the second rotary plate 330 is provided with the second key-receiving recess 333, the first and second key-receiving recesses 223 and 333 having equal widths. When the support bracket 200 provided with the first rotary plate 220 is rotated and when the first key-receiving recess 223 formed in the first rotary plate 220 and the second key-receiving recess 333 formed in the second rotary plate 330 are aligned, the key 224 is inserted into the key hole formed by a combination of the first and second key-receiving recesses 223 and 333.

As described above, when the present disclosure is applied to a combustor of a gas turbine, the entire area of the flange provided at the rear end of the transition piece can be securely and stably fixed to the turbine end. Therefore, it is possible to prevent rotary deformation which is likely to occur due to the hinged coupling structure of the support brackets, thereby preventing a gas leakage at the rear end of the transition piece.

Particularly, for a combustor installed at a lower side of a gas turbine and subjected to a stronger rotary force in the reverse direction due to a higher self-load, it is possible to prevent the gas leakage attributable to the stronger rotary force.

In the foregoing detailed description of the present invention, only specific embodiments thereof have been described. It is to be understood, however, that the invention is not limited to the specific forms described above, but on the contrary, the present disclosure covers all modifications, equivalents, and alternatives falling within the spirit and scope of the invention as defined by the appended claims.

That is, the present disclosure is not limited to the above-described specific embodiments and description, and various changes and modifications thereof may be made without departing from the scope of the present invention as defined in the appended claims by those skilled in the art. In addition, such variations may fall within the scope of protection of the present disclosure.

What is claimed is:

1. A transition piece support structure for supporting a rear end portion of a transition piece fixed to an end of a turbine, the transition piece support structure comprising:

a flange provided at a rear end of the transition piece and configured to be coupled to the end of the turbine, the flange having a shape to fit a periphery of an inlet of the turbine;

a support bracket integrated with an upper surface of a flow sleeve surrounding an outer surface of the transition piece and configured to face the end of the turbine coupled to the flange;

a connection piece coupled to the end of the turbine and configured to be coupled to the support bracket in a hinged manner allowing the flange to pivotally approach the inlet of the turbine; and a rotation control member provided at a contact between the support bracket and the connection piece, the rotation control member protruding from a first surface of the support bracket and from a second surface of the connection piece, the first and second surfaces facing each other.

2. The transition piece support structure according to claim 1, wherein the rotation control member includes a first rotary plate that protrudes from the first surface of the support bracket and a second rotary plate that protrudes from the second surface of the connection piece, the first and second rotary plates configured to engage with each other.

3. The transition piece support structure according to claim 2, wherein each of the first rotary plate and the second rotary plate includes teeth-shaped protrusions configured to allow a first direction rotation but to prohibit a second direction rotation which is reverse with respect to the first direction rotation.

4. The transition piece support structure according to claim 2, wherein the rotation control member comprises:

a key for preventing rotation of the support bracket; and a first key-receiving recess formed in a surface of the first rotary plate and a second key-receiving recess formed in a surface of the second rotary plate, the first and second key-receiving recesses having an equal width, wherein, by a relative rotation of the first and second rotary plates, the first key-receiving recess and the second key-receiving recess can be aligned with each other to form a key hole for receiving the key.

5. The transition piece support structure according to claim 1, wherein the flange includes a bolting plate extending downward from a lower end of the flange, for coupling the flange to the end of the turbine.

6. The transition piece support structure according to claim 5, wherein the bolting plate is provided with at least two coupling holes spaced apart from each other in a width direction of the flange.

7. The transition piece support structure according to claim 1, further comprising:

a pin unit provided to couple the connection piece and the support bracket and configured to enable a relative rotation between the connection piece and the support bracket.

8. The transition piece support structure according to claim 7, wherein the support bracket is configured as at least two brackets protruding from the upper surface of the flow sleeve, and the pin unit is configured with at least two pins to couple the at least two brackets respectively to the connection piece in the hinged manner.

9. The transition piece support structure according to claim 7, wherein the pin unit comprises:

a bolt passing through the support bracket and the connection piece to engage with a nut;

a first washer disposed between a bolt head of the bolt and the support bracket; and a second washer disposed between the connection piece and the nut.

10. The transition piece support structure according to claim 1, wherein the support bracket protrudes from the upper surface of the flow sleeve so as to be disposed in front of the flange.

11. A gas turbine combustor provided with a transition piece support structure, the gas turbine combustor comprising:

a transition piece;

a liner having one end connected to the transition piece; and a flow sleeve configured to surround outer surfaces of the transition piece and the liner, wherein the transition piece support structure comprises:

a flange provided at a rear end of the transition piece and configured to be coupled to the end of the turbine, the flange having a shape to fit a periphery of an inlet of the turbine;

a support bracket integrated with an upper surface of a flow sleeve surrounding an outer surface of the transition piece and configured to face the end of the turbine coupled to the flange;

a connection piece coupled to the end of the turbine and configured to be coupled to the support bracket in a hinged manner allowing the flange to pivotally approach the inlet of the turbine; and a rotation control member provided at a contact between the support bracket and the connection piece, the rotation control member protruding from a first surface of the support bracket and from a second surface of the connection piece, the first and second surfaces facing each other.

12. A method of installing a transition piece support structure to fix a transition piece for a gas turbine combustor to a turbine end, the method comprising:

bringing a support bracket integrated with an upper surface of a flow sleeve surrounding an outer surface of the transition piece close to a connection piece fixed with respect to the turbine end;

coupling the connection piece and the support bracket in a hinged manner using a rotation control member provided at a contact between the support bracket and the connection piece, the rotation control member protruding from a first surface of the support bracket and from a second surface of the connection piece, the first and second surfaces facing each other;

rotating the transition piece together with the support bracket with respect to the connection piece so that a flange provided at a rear end of the transition piece pivotally approaches a turbine inlet;

fitting the flange to a periphery of the turbine inlet; and fixing the flange to the turbine end.

13. The method according to claim 12, wherein the fixing of the flange comprises inserting a bolt through a coupling hole formed in a bolting plate extending downward from a lower end of the flange.

14. The method according to claim 12, wherein the coupling of the connection piece and the support bracket comprises inserting a pin unit, the pin unit enabling the rotation of the transition piece together with the support bracket with respect to the connection piece.

* * * * *